US008535185B2

(12) United States Patent
Englert

(10) Patent No.: US 8,535,185 B2
(45) Date of Patent: Sep. 17, 2013

(54) ACQUIRING AND PROVIDING PLAYER INFORMATION BY MEANS OF A MULTIPLE SENSOR SYSTEM

(75) Inventor: Walter Englert, Burgrieden (DE)

(73) Assignee: Cairos Technologies AG (DE)

( * ) Notice: Subject to any disclaimer, the term of this patent is extended or adjusted under 35 U.S.C. 154(b) by 61 days.

(21) Appl. No.: 13/129,784

(22) PCT Filed: Nov. 17, 2009

(86) PCT No.: PCT/EP2009/008161
§ 371 (c)(1),
(2), (4) Date: Aug. 10, 2011

(87) PCT Pub. No.: WO2010/054848
PCT Pub. Date: May 20, 2010

(65) Prior Publication Data

US 2011/0287878 A1 Nov. 24, 2011

(30) Foreign Application Priority Data

Nov. 17, 2008 (DE) ..... 10 2008 057 685

(51) Int. Cl.
*A63B 43/00* (2006.01)
*A63B 71/06* (2006.01)
*G01P 15/105* (2006.01)
*G01P 15/00* (2006.01)

(52) U.S. Cl.
USPC ..... 473/570; 73/514.16; 73/514.31

(58) Field of Classification Search
USPC ..... 473/570, 471, 446; 273/DIG. 18; 463/36, 37; 702/141
See application file for complete search history.

(56) References Cited

U.S. PATENT DOCUMENTS

| | | | | |
|---|---|---|---|---|
| 5,723,786 | A * | 3/1998 | Klapman | 73/379.04 |
| 6,151,563 | A * | 11/2000 | Marinelli | 702/141 |
| 6,441,745 | B1 * | 8/2002 | Gates | 340/669 |
| 6,921,332 | B2 * | 7/2005 | Fukunaga et al. | 463/8 |
| 7,070,500 | B1 * | 7/2006 | Nomi et al. | 463/7 |

(Continued)

FOREIGN PATENT DOCUMENTS

| | | |
|---|---|---|
| DE | 10338620 | 3/2005 |
| WO | 99/36859 | 7/1999 |
| WO | 2007/014700 | 2/2007 |

OTHER PUBLICATIONS

Tsaousidis N.; Zatsiorsky V. "Two types of ball-effector interaction and their relative contribution to soccer kicking", Dec. 1996, Elsevier, Human Movement Science, vol. 15, No. 6, pp. 861-876.*

*Primary Examiner* — Arthur O. Hall
*Assistant Examiner* — Nicholas Ditoro
(74) *Attorney, Agent, or Firm* — Workman Nydegger

(57) ABSTRACT

A device (120) for acquiring and providing information which can be associated with a football player, said device comprising: an acceleration sensor (129) for detecting accelerations acting on the devices; a memory unit (121) for storing measured acceleration values with associated time stamps and an ID associated with the device (120); and a radio unit (128) for receiving a first radio signal (150) with a first time stamp, wherein the first radio signal represents a deformation of a ball, and for transmitting a second radio signal (160) including the ID associated with the device (120) in case that a check of the values in the memory unit shows that an acceleration was detected by the device at the corresponding time.

3 Claims, 4 Drawing Sheets

(56) References Cited

U.S. PATENT DOCUMENTS

| | | | | |
|---|---|---|---|---|
| 8,209,882 | B2 * | 7/2012 | Leimer et al. | 36/3 R |
| 8,287,434 | B2 * | 10/2012 | Zavadsky et al. | 482/5 |
| 2006/0047447 | A1 * | 3/2006 | Brady et al. | 702/41 |
| 2007/0191083 | A1 * | 8/2007 | Kuenzler et al. | 463/7 |
| 2008/0207357 | A1 * | 8/2008 | Savarese et al. | 473/407 |
| 2009/0029754 | A1 * | 1/2009 | Slocum et al. | 463/5 |
| 2009/0048044 | A1 * | 2/2009 | Oleson et al. | 473/570 |
| 2009/0048070 | A1 * | 2/2009 | Vincent et al. | 482/8 |
| 2009/0113762 | A1 * | 5/2009 | Leimer et al. | 36/114 |
| 2012/0135825 | A1 * | 5/2012 | Claudel et al. | 473/446 |

* cited by examiner

ACQUIRING AND PROVIDING PLAYER INFORMATION BY MEANS OF A MULTIPLE SENSOR SYSTEM

CROSS-REFERENCE TO RELATED APPLICATIONS

This application is a U.S. National Phase entry of International Patent Application No. PCT/EP2009/008161 filed Nov. 17, 2009, which claims priority to German Patent Application No. 10 2008 057 685.9, filed Nov. 17, 2008, which is incorporated herein by reference in its entirety.

BACKGROUND OF THE INVENTION

The present invention relates in general to acquiring and providing player-related information for ball games, and specifically to acquiring and providing player-related information for those ball games such as football, where a ball is hit by a game device which can be associated with a player.

There is an interest to an increasing degree to study moving objects in a ball game, especially the persons participating in the ball game and the object of the game, the ball, with respect to their sequence of motions, their interaction and other characteristic parameters, so as to allow an objective evaluation within the scope of these complex systems.

Especially in the football sector, no matter whether played as a hobby, in a club or on a professional basis, there is an increased interest in making the complex courses of action during the game and the handling of the ball, which cannot be visually resolved satisfactorily, analytically processable. The answers to questions like "Who touched the object of the game how many times?", "Who had a significant influence on the object of the game, and how long?" and "Who has moved the object of the game to which member of the opposing team or teammate?" as well as to questions concerning the manner of the game object handling provide evidence for the final outcome of a game and information about the qualities of a player of the ball game.

The answers to those questions are of interest especially for training sessions where they are analyzed. Contrary to that it is, in general, not desired to negatively affect the professional game by technical measures that might be disturbing.

In golf, tennis or football game devices and game objects (balls) can be accelerated to speeds that are so high that the detection of the object during the motion requires a specifically adapted technology. Technical means, mainly cameras, used so far do often not meet the requirements made with regard to precision or involve too great a processing effort. Moreover, known methods for determining a position by means of corresponding transmitter and receiver combinations do not permit the necessary spatial resolution and frequently suffer from problems owing to transmitter/receiver components the dimensions of which are too large, which do not allow a reasonable use in the sports equipment such as the ball, football shoe, tennis racket or golf club.

This means that there is a specific need for a solution in ball games, especially football, which allows to determine the number of times a player has hit the ball, how long he was in the possession of the ball, i.e. how long he was in a position that determined the motion of the ball, the shot power exerted by the player on the ball, and when, and the distance covered by the respective player on the playing field with or without the ball.

According to already known solutions the shot power was measured by a pressure sensor unit in the ball, preferably football. Distances covered by the player were typically evaluated by means of known step counters or by a visual detection of the player, preferably by video, and a corresponding manual or automatic analysis.

Specifically, it was already proposed by the applicant of the present application before, compare DE 10 2007 001 820, to introduce a coil into the shoe, specifically the football shoe, which then generates the desired magnetic field. This previous solution for detecting by whom the ball was hit was based on the generation of a magnetic field in the football shoe by means of a magnetic field generator, which magnetic field could be associated with the player, and on the detection of the magnetic field associated with the player by means of a magnetic field sensor in the ball, in order to obtain on the basis of these information a ball contact information indicating whether the player contacted the ball.

Although this solution has proved itself in practice, there is the problem, especially when the football shoes are particularly light, that there is not enough space in the football shoe for the technology and the weight thereof necessary for the generation of a sufficiently strong magnetic field, and that the installation of such a device additionally has a negative effect on the comfort of the football shoe owing to the space required by it.

To overcome this problem, it is possible to generate the magnetic field no longer in the football shoe or generally on the player's side. Instead, coils generating the field are installed in the ball once. To this end, the football shoe is merely provided with a magnetic field sensor which detects the magnetic field of the ball when the ball is contacted or when it enters the proximity of the ball, and transmits an identification code (ID) associated with the player to the ball.

The present invention is based on the knowledge that it is also possible and advantageous to waive the generation of an alternating magnetic field in the system consisting of the shoe and the ball, and to provide the ball with a combination of at least one pressure sensor and an acceleration sensor and install a device comprising an acceleration sensor and preferably a magnetic field sensor in the football shoe instead. In order to detect the kicking player the ball and the football shoe then establish a radio contact so as to transmit the ID of the device of the kicking player.

A contact with the ball is detected in the ball by a pressure measurement. In response thereto a signal is transmitted from the ball to the shoe. The reception of this signal triggers the transmission of an ID in the shoe. The ID is then transmitted by a transmitter in the football shoe to the ball, where it is temporarily stored. Alternatively, it is also possible that the shoe transmits this ID to a central unit. For technical reasons, and in particular in consideration of possible ranges and transmit powers it is an advantage, however, if the ID is transmitted to the ball, where it is temporarily stored and read out once, for instance after a game or a training session, together with the entirety of the collected player information.

The transmission of the ID associated with the device can be accomplished by a radio module, e.g. in the 2.4 GHz range. A suited radio module for the shoe is produced by the company Nordic and is already used in the field of WLAN.

Preferably, the shoe, just like the ball, comprises an own power source, which may be very small, however, and which serves the power supply at least of the radio modules. Advantageously, the magnetic field sensor used further comprises a magneto-resistive element.

The present invention allows determining the quality of a player by evaluating selected characterizing parameters. Specifically, it is detected how many times and how long a certain player contacts the ball, and whether he accomplishes a successful pass at a certain frequency. Thus, by evaluating the collected data, an objectified measure can be determined for the quality of a player. Furthermore, a successful pass can be detected by recognizing that the hit ball is received by a fellow player of his own team. This is possible by comparing the transmitted IDs with respect to their association with players of the same team.

Previous, simplified shot power measurements are obtained by pressure measurements with pressure sensors in the ball. If it is desired, however, to measure not only the shot power of previously motionless balls, but also of rolling balls or balls approaching the player through the air and being hit by the player directly, it is a fundamental problem that the measurement by the pressure sensor is then dependent on the angle at which the ball encounters the player, and particularly on whether or not the ball comes from the front. According to the knowledge of the inventors this is due to the fact that balls approaching the player from the front experience a deformation which is largely independent of the pulse vector of the encountered ball, thereby causing a shot power determination by means of a pressure sensor measurement which does not correspond to the actually applied shot power to the desired extent. Hit balls approaching the player from the side or the back do not induce such a distortion of the shot power obtained by the pressure measurement.

Hence, in order to overcome this problem, it is necessary to detect when a ball comes from the front and when a ball does not come from the front. For balls not approaching the player from the front or not being in the shot direction towards the player the measurement by means of pressure is exactly enough. If the ball comes from the front, however, a correction by a determinable constant has to be made so as to be able to detect the correct shot power by means of the pressure measurement. Therefore, it is necessary to detect those cases in which the ball comes from the front.

The invention is based on the additional knowledge that this differentiation is possible by a combined consideration of a pressure sensor and an acceleration sensor. If the shot power determination by the acceleration sensor shows a greater value than that by the pressure sensor, this is an indication that the ball approached the player from the front.

According to another aspect the pressure, the acceleration and the rotation is determined. The rotation is determined by a magnetic field sensor in the ball.

At the time of a kick the pressure sensor located in the ball can detect this kick. The ball transmits a first radio signal to the shoe. The shoe receives this first radio signal, thus knowing that a kick was made. Then, in the shoe, a history of acceleration data detected by an acceleration sensor in the shoe with associated time stamps is checked. If the result shows that the shoe, too, experienced an acceleration at the same time it is determined that the kick was made by the player of this shoe. The shoe transmits an ID associated with the device located in the shoe to the ball in order to document the kicking player.

Moreover, the present invention makes it possible to determine the paths of individual players during a training session or during a game. Video analyses, as are commonly carried out in professional games, require laborious video controls that are not available in typical training sessions or on leisure football grounds. Therefore, an easy solution is desirable.

According to a knowledge of the present invention the shoe should comprise at least one acceleration sensor and a magnetic field sensor in order to determine the covered path. The covered path can be calculated by means of a double time integration of the measured accelerations. Due to the integration and the uncertainty with respect to a non-accelerated motion constants occur, which may distort the result of the so determined path. Therefore, it is desired to determine the phases of actual motion more exactly in order to be able to limit the integration to these periods.

The present invention proposes that the magnetic field sensor in the shoe is also capable of detecting a tilt of the foot relative to the earth's magnetic field. To determine the phases of actual motion or missing motion more exactly the magnetic field sensor may be used, which can determine the periods in which an unchanged constant tilt relative to the earth's magnetic field is present, the shoe rests on the playing surface, so that a shoe speed of the value zero can be concluded. This determination can be carried out separately for each of the two shoes of the player. Furthermore, as the acceleration data, too, can be determined separately for both shoes, it is possible to carry out an averaging of the two calculated paths so as to obtain an error minimization. Advantageously, a resting of the player's shoe is determined only when a time threshold $T_1$ is exceeded.

A foot being in full contact with the ground is tilted relative to the earth's magnetic field in a constant manner over a certain period and will therefore generate a recurring reference signal for the magnetic field measurement. The moving foot deviates from this reference signal owing to its motion sequence. The determination of the ground contact phases further allows conclusions to the number of steps and, thus, also to the step frequency of the respective player. By introducing suitable approximations for the length of the step a sufficiently precise alternative determination of the covered paths is possible, especially for types of sport not involving a ball, which permits a comparison with the path determined by means of acceleration integration. A determination of the covered path in this manner for a type of sport involving a ball is only approximately reliable.

Preferred embodiments of the present invention shall be explained in more detail below with reference to the accompanying drawings. In the drawings.

In order to elucidate the invention the accompanying drawings shall now be explained in more detail. The following description of the drawings is based on embodiments of the invention. It will be appreciated, however, that the present invention is not limited to the individual embodiments. In particular, the present invention is explained in detail in connection with football games, while its use is not limited to this specific ball game.

Figure 1:
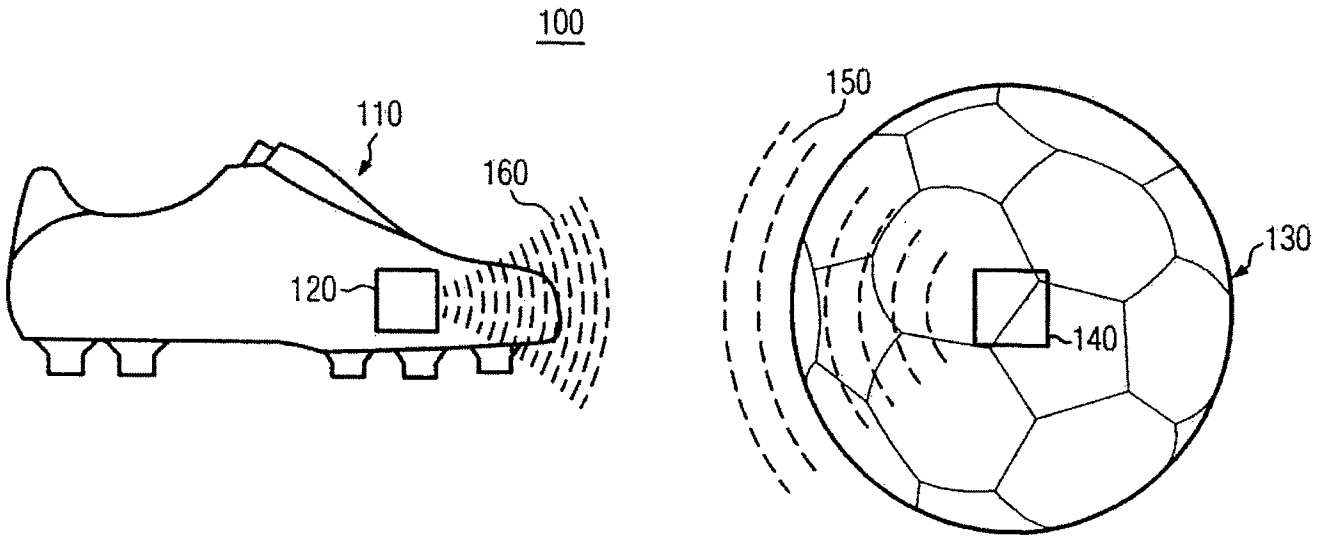
FIG. 1 shows a schematic representation of a system according to an embodiment of the present invention.

FIG. 1 shows a schematic representation of a system consisting of a device installed in a football shoe and a ball according to an embodiment of the present invention. The system 100 comprises a football shoe 110 and a ball 130. The present invention is not limited to the use in football games. Rather, the present invention can be used in other ball games comprising a game device provided to act on the ball. Ball games in which the ball is hit with bare hands, without the use of a game device in between, may likewise represent fields of application of the present invention if a device 120 is fixed, for instance, to the players' wrists by means of a wristband or the like.

The football shoe 110 comprises a device 120. The ball 130 contains a system 140 mounted, for instance, in the center of the ball, which may be accomplished by fixing it between suited springs, soft foam or suitably shaped assemblies of interior bubbles. The present invention is not limited to these mounting methods, however. System 140 comprises at least one pressure sensor, an acceleration sensor as well as radio transceiver. Preferably, a magnetic field sensor is provided as well, which makes use, for instance, of a magneto-resistive element.

The shoe 110 comprises the device 120, which may include a magnetic field sensor, an acceleration sensor and a radio transmission unit. Upon determining a ball contact the device 120 can transmit a radio signal with an ID back to the ball 130. To this end, for instance a high-frequency signal is used, with 2.4 GHz as carrier frequency.

Figure 2:
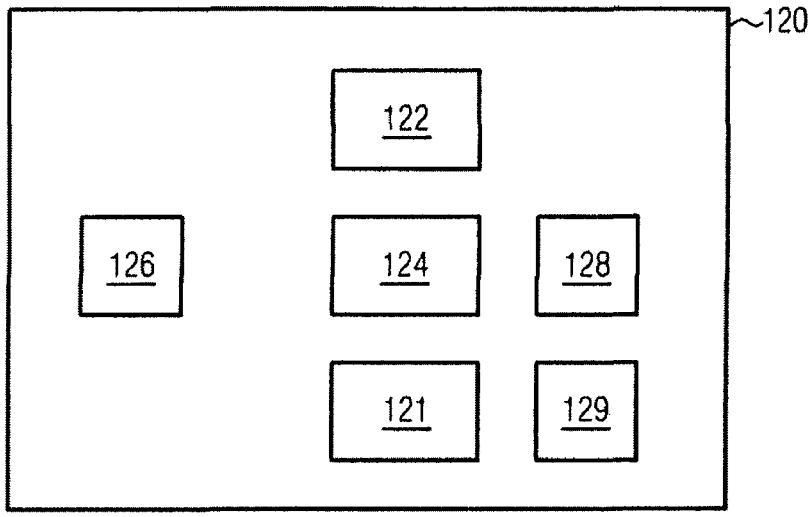
FIG. 2 shows a schematic representation of a device on the player's side according to an embodiment of the present invention.

FIG. 2 shows a schematic block representation of the device 120. The device 120 comprises a magnetic field sensor 122, which may be used to measure the earth's magnetic field. The magnetic field sensor 122 preferably includes a magneto-resistive element or a Hall element. If the magnetic field strength is measured by magneto-resistive sensors as magnetic field dependent resistors they may be interconnected to form a bridge. The output signal of the bridge can be amplified by a difference amplifier. The output voltage is a direct measure for the field strength of the measured magnetic field. In order to receive an optimal signal at each possible axis of rotation relative to the earth's magnetic field two or three sensors each offset by 90 degrees can be used.

Alternatively, the field strength can be measured by Hall sensors. Hall sensors generate a voltage proportional with respect to the field strength. This voltage can be amplified by a difference amplifier. The output voltage is a direct measure for the field strength of the magnetic field. The evaluation of this voltage can be carried out either discretely by means of an analog circuit or by means of a control unit, e.g. a microcontroller. In order to receive an optimal signal at each possible axis of rotation relative to the earth's magnetic field two or three sensors each offset by 90 degrees can be used.

The device 120 comprises an acceleration sensor 129 for measuring the accelerations occurring at the football shoe. The device 120 further comprises a control unit 124 which may be provided in the form of a microcontroller or an application-specific integrated circuit. A control unit 124 controls instructions and the evaluation, the further processing and storage of magnetic field measurement values and acceleration measurement values, and generates associated time stamp values which may be passed on to a memory 121 and/or a transmit unit 128. The device 120 further comprises a power source 126. According to an embodiment of the present invention the power source 126 is a battery. For instance, the device 120 is supplied with power by a lithium battery, with the capacity of the battery being adapted to ensure the functionality of the electronic system in the device 120 over a certain number of several hundred or thousand operating hours.

Preferably, the power source 126 may be provided as a replaceable unit, which can be replaced by the user without much effort.

Figure 3:
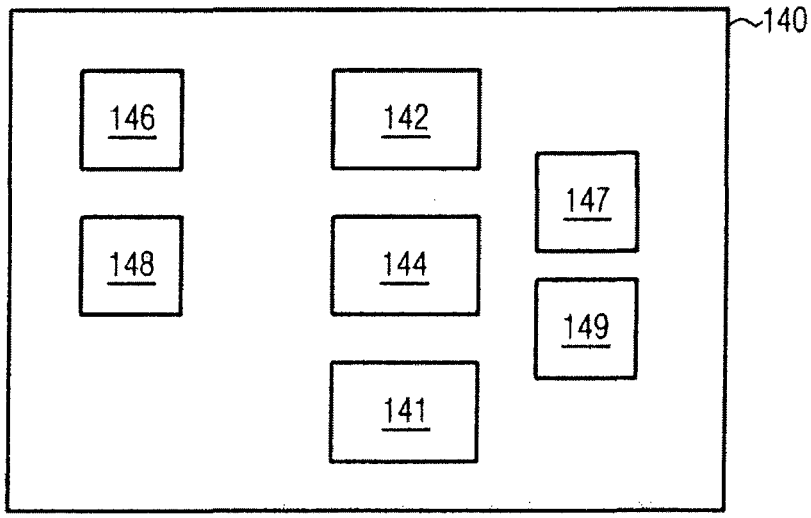
FIG. 3 shows a schematic representation of a system on the ball's side according to an embodiment of the present invention.

FIG. 3 shows in a schematic block representation a system 140 in a ball 130 according to a preferred embodiment of the invention. System 140 is illustrated as a closed one. This illustration serves to facilitate the illustration of the means provided for the present invention in the ball. Also, the invention comprises a distributed arrangement of the different units in the ball, including sensors, a transceiver and a power source. The system 140 comprises a magnetic field sensor 142, which may be configured in correspondence with magnetic field sensor 122. According to an embodiment of the present invention the power source 146 is a battery. For instance, the power source 146 may be a lithium battery. The capacity of the battery may be adapted to ensure the functionality of the electronic system in system 140 over a certain number of operating hours, e.g. several hundred to several thousand hours. Also, a rechargeable power source 146 may be provided. For instance, a power source 146 may be used which is recharged during a readout operation of the data stored in memory 141 by means of induction or a direct power supply. Additionally, a control unit 144 is provided in the ball. The control unit 144 particularly serves to control the transceiver 148, to analyze data and to control the communication flow in the system 140. Specifically, the detection signals received by the transceiver 148, which are transmitted from a device 120 to the ball 130, are acquired by the control unit 144, are processed further and, if necessary by adding associated time stamps, are stored in the memory unit 141.

The information data sets stored in the memory unit 141 can be read out from system 140 by a central readout station. To this end, a transceiver 148 may be provided for the transmission of the data. Alternatively, a second communication unit may be provided, which is not illustrated in FIG. 3.

Particularly, the device 140 comprises a pressure sensor 147 and an acceleration sensor 149. These additional sensors may be mounted in the ball outside the ball center and may be connected via the control unit 144 for readout.

The power sources 126 and 146 in FIG. 2 and FIG. 3 serve the power supply of the complete electronic device 120 and the complete electronic system 140, respectively.

Figure 4:
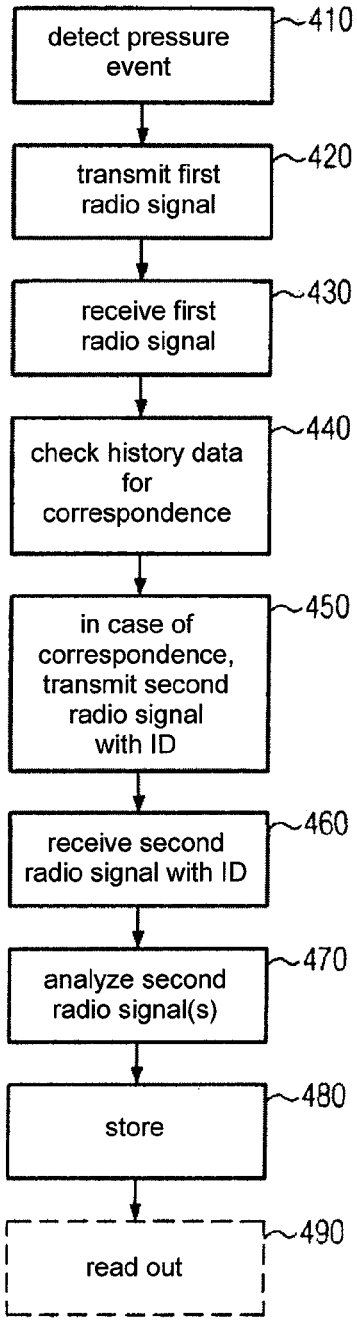
FIG. 4 shows a flow diagram to explain a method for acquiring ball contact information according to an embodiment of the present invention.

FIG. 4 shows a flow diagram to explain a method for detecting a ball contact between a football shoe 110 and a ball 130.

Initially, the system 140 detects a significant deformation of the ball by means of a pressure sensor 147, step 410, and, for determining the causer of the ball contact, transmits in response thereto a first radio signal with a time stamp associated with the detection of the deformation to devices 120 potentially located in the environment, step 420. This first radio signal is received by a device 120, step 430. In response thereto, a history of acceleration data with associated time stamps is checked in device 120, step 440. If a time correspondence of a relevant acceleration event with the detected deformation is determined, device 120 transmits a second radio signal with an ID associated with the device 120, step 450. Preferably, an acceleration measurement value, too, can be transmitted with this second radio signal. The code transmission can be accomplished by modulating a carrier signal which is transmitted, for instance, at 2.4 GHz. To this end, a transmit unit 128 is used, e.g. a radio module of the company Nordic, which is known from the field of WLAN.

The transmission of a measured acceleration allows the determination of a player actually kicking the ball, in situations in which several football shoes of different players with correspondingly different ID codes transmit second radio signals to the ball, that is, communicate competitive information to the ball. In step 460, device 140 in the ball receives the second radio signal(s). According to an embodiment, these radio signals can be analyzed in step 470, for instance, with respect to the above-described conflict removal. The second radio signal is assigned a time stamp in step 480, and the value pair of ID and time stamp is stored in the memory unit 141 of the ball for the readout at a later time.

According to preferred embodiments all value pairs stored in memory 141, which additionally may be preprocessed by the control unit 144, are read out once after a certain training session or game, step 490.

Figure 5:
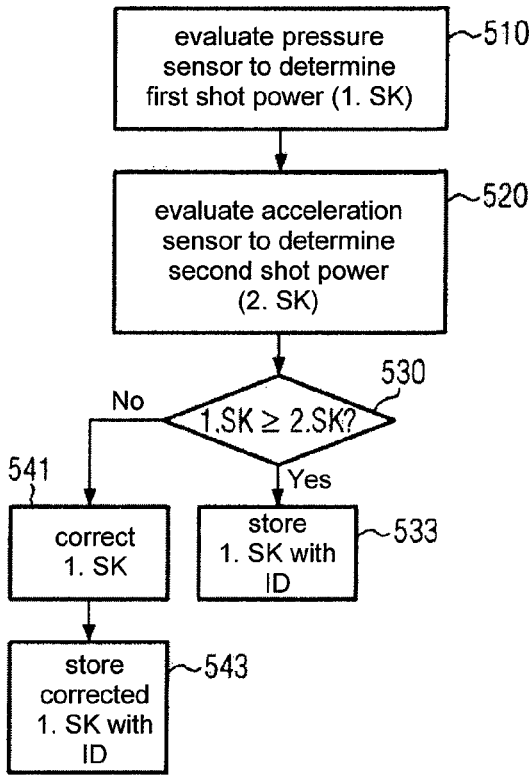
FIG. 5 shows a flow diagram to explain a method for determining the shot power according to an embodiment of the present invention.

FIG. 5 shows a flow diagram to explain a method for determining the shot power upon a ball contact according to an embodiment of the present invention. In this embodiment, the system 140 in the ball 130 comprises a pressure sensor 147 and an acceleration sensor 149.

In steps 510 and 520 respective independent shot power values are determined by an evaluation of the pressure sensor 147 (1.SK) and an evaluation of the acceleration sensor 149 (2.SK).

By means of the pressure sensor 147, which may comprise a suitable pressure sensor assembly, the extent of the deformation of the ball can be determined. The greater the deformation, the greater is the shot power. To this end, the peak value and the pressure pattern of the internal pressure can be measured by the pressure sensor. The control unit 144 can determine the energy supplied to the ball by the comparison with a group of curves. Such a group of curves can be determined empirically by means of a suitable test facility. Also, a shot power can be determined by the acceleration sensor 149 from the measured accelerations, based on suitable assumptions and approximations.

In order to overcome the above-described problem, namely the dependence of the accuracy of the shot power determination by the pressure sensor 147 on the direction of arrival of the ball relative to the shot direction, a correction term is added to the shot power value determined by means of the pressure measurement when the ball arrives from a front direction. This is indicated if the shot power value determined from the acceleration is greater than the shot power value determined by the pressure measurement.

The comparison of the determined values takes place in step 530. If the $2^{nd}$ SK is greater than the $1^{st}$ SK, a correction term is added to the $1^{st}$ SK in step 541, and this corrected shot power value is stored in step 543, preferably together with the ID determined in accordance with the method of FIG. 4. If the $1^{st}$ SK is greater than or equal to the $2^{nd}$ SK, however, an arrival of the ball from the back or from the side is concluded, and the shot power value determined by the pressure measurement is stored directly in step 533.

Figure 7:
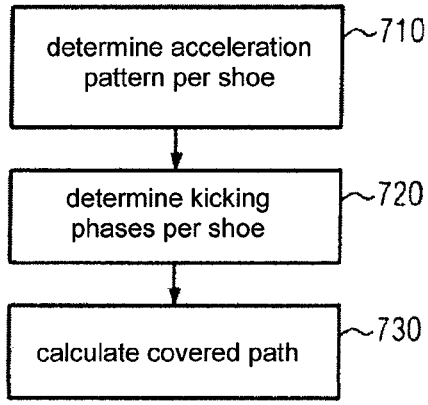
FIG. 7 shows a flow diagram to explain a method for determining the path according to an embodiment of the present invention.

FIG. 7 shows a flow diagram to explain a method for determining the path according to an embodiment of the present invention. In step 710, the time-wise acceleration pattern in the shoe is determined separately for each shoe of the football player. To this end, accelerations measured, for instance, periodically by an acceleration sensor 129 are stored with associated time stamps in a memory 121.

A foot being in full contact with the ground is tilted relative to the earth's magnetic field in a constant manner over a certain period and will therefore generate a recurring reference signal for a magnetic field measurement by means of a magnetic field sensor 122 in the shoe. The moving foot deviates from this reference signal owing to its motion sequence. In step 720, the kicking phases are determined, preferably separately for each of both shoes of the player. In step 730, the covered path is calculated on the basis of the knowledge of these kicking phases and the so permitted limitation of the integrated time intervals.

Figure 6A:
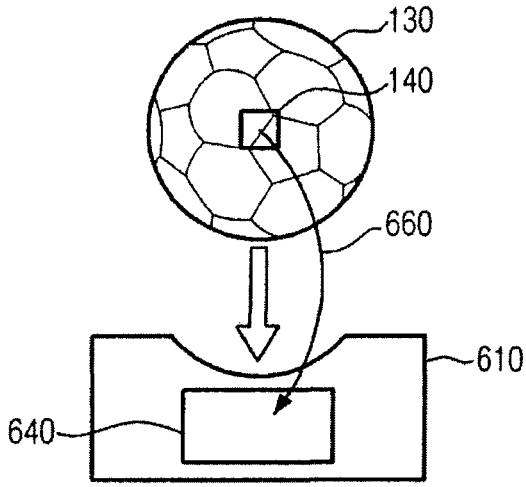
FIG. 6A shows a schematic representation of a readout system according to an embodiment of the present invention.
Figure 6B:
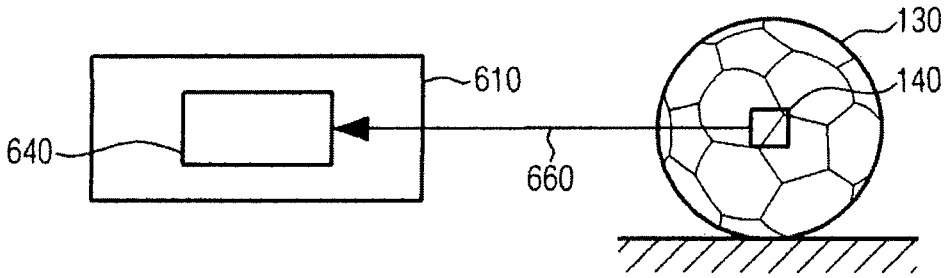
FIG. 6B shows a schematic representation of an alternative readout system according to an embodiment of the present invention.

FIGS. 6A and 6B show schematic representations of preferred readout assemblies according to embodiments of the present invention.

According to the embodiment illustrated in FIG. 6A the ball 130, for reading it out, is brought into the proximity of or onto a concave hollow of a readout device 610 including a radio transceiver 640. According to the embodiment illustrated in FIG. 6A the radio transmission 660 between the transceiver 148 and transceiver 640 is a short-range one.

According to the embodiment illustrated in FIG. 6B the player information stored in memory 141 of the ball or, alternatively, the acquired data can be transmitted directly from the control unit 144, by bypassing the memory 141, via transceiver 148, e.g. from the playing field, to a readout device 610 including a radio receiver 640. According to the embodiments a portable media player or a mobile phone are provided as readout device 610.

According to the present invention reading out an inventive ball allows to obtain detailed information on parameters of the players participating in the game. In addition to the direct analysis of the power development of a player this permits, for instance, an uploading of player-related characteristics in centralized databases that allow a comparison of hobby players, e.g. via the internet. Thus, it is of interest for different providers that players voluntarily put their data on the internet for a mutual sportive comparison. The present invention further makes it possible that players become absolutely comparable with each other in terms of objectified performance values, even if they have never played together or against each other, similar to golf. In the semi-professional or professional field it is moreover provided to render the training performance of players reproducible and prepare a concept for training schedules on the basis of the determined data.

The invention claimed is:

1. A ball comprising an acceleration sensor, a pressure sensor, and a control unit for comparing a shot power measured by means of the pressure sensor and acting on the ball with a shot power determined by means of the acceleration sensor, wherein, if the shot power value determined by the acceleration sensor is greater than the shot power value determined by the pressure sensor, the control unit performs the steps of: generating a corrected value via adding a correction value to the shot power value determined by the pressure sensor and performs at least one of storing the corrected value or transmitting the corrected value to a readout device.

2. A system, comprising:

a device for acquiring and providing information which can be associated with a football player, said device comprising:

an acceleration sensor for detecting accelerations acting on the device;

a memory unit for storing measured acceleration values with associated time stamps and an ID associated with the device; and a radio unit for receiving a first radio signal with a first time stamp, wherein the first radio signal represents a deformation of a ball, and for transmitting a second radio signal including the ID associated with the device in case that a check of the values in the memory unit shows that an acceleration was detected by the device at a corresponding time; and a ball comprising the acceleration sensor, a pressure sensor, and a control unit for comparing a shot power measured by means of the pressure sensor and acting on the ball with a shot power determined by means of the acceleration sensor, wherein, if the shot power value determined by the acceleration sensor is greater than the shot power value determined by the pressure sensor, the control unit performs the steps of: generating a corrected value via adding a correction value to the shot power value determined by the pressure sensor and performs at least one of storing the corrected value or transmitting the corrected value to a readout device.

3. A system, comprising:

a device for acquiring and providing information which can be associated with a football player, said device comprising:

a magnetic field sensor for detecting and measuring a magnetic field, preferably the earth's magnetic field;

an acceleration sensor for detecting accelerations acting on the device;

a memory unit for storing measured acceleration values and measured magnetic field values with associated time stamps; and a control unit for calculating a covered path based on a time pattern of the measured magnetic field values and acceleration values; and a ball comprising an acceleration sensor, a pressure sensor, and a control unit for comparing a shot power measured by means of the pressure sensor and acting on the ball with a shot power determined by means of the acceleration sensor, wherein, if the shot power value determined by the acceleration sensor is greater than the shot power value determined by the pressure sensor, the control unit performs the steps of: generating a corrected value via adding a correction value to the shot power value determined by the pressure sensor and performs at least one of storing the corrected value or transmitting the corrected value to a readout device.

* * * * *